US010126103B2

(12) United States Patent
Barker et al.

(10) Patent No.: US 10,126,103 B2
(45) **Date of Patent: *Nov. 13, 2018**

(54) PERFORATING SYSTEMS WITH INSENSITIVE HIGH EXPLOSIVE

(71) Applicant: Halliburton Energy Services, Inc., Houston, TX (US)

(72) Inventors: James Marshall Barker, Mansfield, TX (US); Thomas Earl Burky, Mansfield, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/501,204

(22) PCT Filed: Sep. 3, 2014

(86) PCT No.: PCT/US2014/053833

§ 371 (c)(1),
(2) Date: Feb. 2, 2017

(87) PCT Pub. No.: WO2016/036357

PCT Pub. Date: Mar. 10, 2016

(65) Prior Publication Data

US 2017/0241244 A1 Aug. 24, 2017

(51) Int. Cl.
*F42B 1/024* (2006.01)
*E21B 43/117* (2006.01)
(Continued)

(52) U.S. Cl.
CPC ..... *F42B 1/024* (2013.01); *E21B 43/116* (2013.01); *E21B 43/117* (2013.01); *E21B 43/1185* (2013.01); *E21B 43/11857* (2013.01)

(58) Field of Classification Search
CPC ..... F42B 1/024; E21B 43/116; E21B 43/1185
See application file for complete search history.

(56) References Cited

U.S. PATENT DOCUMENTS 4,527,481 A * 7/1985 Evans ..... F42C 19/10 102/204
4,632,034 A * 12/1986 Colle, Jr. ..... E21B 43/116 102/275.11

(Continued)

FOREIGN PATENT DOCUMENTS

EP 2264279 12/2010

OTHER PUBLICATIONS

International Search Report and Written Opinion, Application No. PCT/US2014/053833; 13 pgs., dated Jun. 13, 2015.

(Continued)

*Primary Examiner* — Stephen Johnson
*Assistant Examiner* — Joshua T Semick
(74) *Attorney, Agent, or Firm* — Baker Botts L.L.P.

(57) ABSTRACT

The disclosure relates to perforating systems for perforating the casing of a wellbore. The perforating systems contain insensitive high explosives. The disclosure also relates to shaped charges containing insensitive high explosives for use in such perforating systems. The disclosure further relates to methods of using such perforating systems to perforate the casing of a wellbore.

13 Claims, 7 Drawing Sheets

(51) Int. Cl.
*E21B 43/1185* (2006.01)
*E21B 43/116* (2006.01)

(56) References Cited

U.S. PATENT DOCUMENTS 4,829,901 A * 5/1989 Yates, Jr. ..... F42B 1/024 102/306
5,322,020 A * 6/1994 Bernard
5,597,974 A * 1/1997 Voreck, Jr. ..... C06B 45/00 102/275.5
6,622,630 B2 * 9/2003 Yang ..... C06C 5/06 102/275.4
6,925,924 B2 * 8/2005 Baker ..... E21B 43/117 89/1.151
9,080,432 B2 * 7/2015 Yang
2002/0139274 A1 10/2002 Yang et al.
2006/0266551 A1 11/2006 Yang et al.
2009/0114382 A1 5/2009 Grove et al.
2013/0061771 A1 * 3/2013 Betancourt
2017/0241245 A1 * 8/2017 Barker

OTHER PUBLICATIONS

International Search Report and Written Opinion, Application No. PCT/US2014/053841; 13 pgs., dated Jun. 3, 2015.
Examination Report received for Great Britain Patent Application No. 1700517.4, dated Feb. 28, 2017; 2 pages.
Examination Report received for Great Britain Patent Application No. 1700241.1, dated Feb. 28, 2017; 2 pages.
International Preliminary Report on Patentability for PCT Patent Application No. PCT/US2014/053833, dated Mar. 16, 2017; 10 pages.
International Preliminary Report on Patentability for PCT Patent Application No. PCT/US2014/053841, dated Mar. 16, 2017; 10 pages.
Examination Report received for Great Britain Patent Application No. 1700241.1, dated Apr. 30, 2018; 4 pages.

* cited by examiner

PERFORATING SYSTEMS WITH INSENSITIVE HIGH EXPLOSIVE

RELATED APPLICATIONS

This application is a U.S. National Stage Application of International Application No. PCT/US2014/053833 filed Sep. 3, 2014, which designates the United States, and is incorporated herein by reference in its entirety.

TECHNICAL FIELD

The present disclosure relates to perforating systems, and more specifically to perforating systems with insensitive high explosives, and to methods of perforating a wellbore using such systems.

BACKGROUND

Once an oil and gas well has been drilled and casings or other support structures have been placed downhole, such structures are perforated to allow the oil or gas to leave the reservoir and enter the wellbore. Perforations are often formed using explosive charges. These perforations may be formed in various types of wellbores, including those formed off-shore and on-shore and in reworks of an existing wellbore.

BRIEF DESCRIPTION OF THE DRAWINGS

A more complete understanding of the present embodiments and advantages thereof may be acquired by referring to the following description taken in conjunction with the accompanying drawings, which show particular embodiments of the current disclosure, in which like numbers refer to similar components, and in which.

DETAILED DESCRIPTION

The present disclosure relates to perforating systems for oil and gas wells in which insensitive high explosives are used. The disclosure also relates to methods of perforating oil and gas wells using insensitive high explosives.

Figure 1:
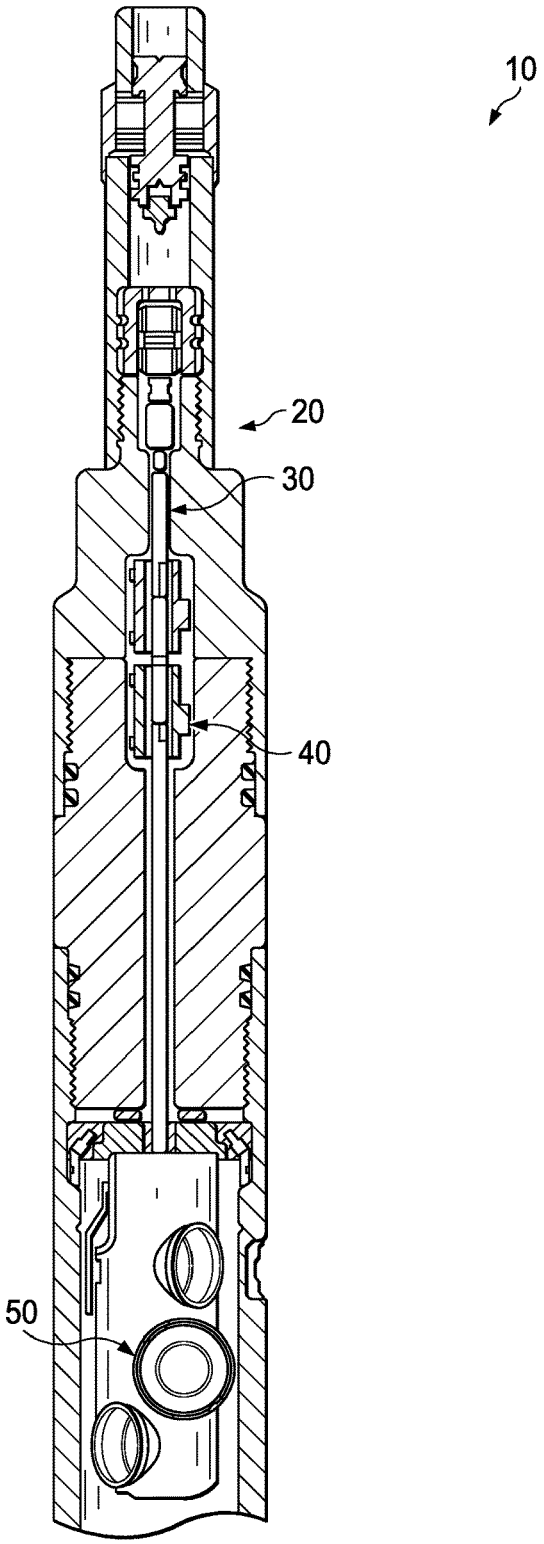
FIG. 1 is a cross-sectional drawing which illustrates a perforating system including an insensitive high explosive.

FIG. 1 illustrates a perforating system 10 containing an insensitive high explosive. The system 10 may contain a detonator 15, detonating cord initiator 20, detonating cord 30, bi-directional boosters 40, and shaped charges 50. The detonator 15 may be initiated by percussion (as shown) or by electrical or optical means.

Figure 2:
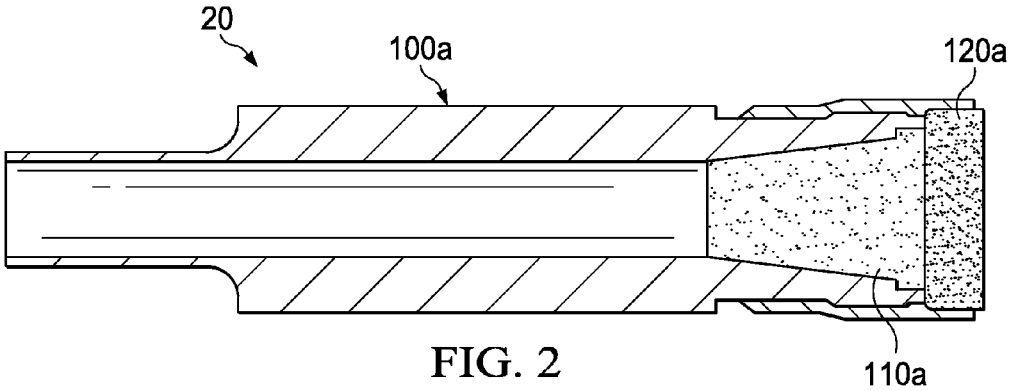
FIG. 2 is a cross-sectional drawing which illustrates a detonating cord initiator.

Detonating cord initiator 20 is further illustrated in FIG. 2 and contains high impedance confinement 100*a*, insensitive high explosive 110*a*, and superfine insensitive high explosive 120*a*. High impedance confinement is enabled by the use of materials with high density and high sound speed, such as steel, copper, brass, tantalum, tungsten, and tungsten carbide. Superfine high explosives are defined as those with particle sizes less than 10 microns, such as 1 micron to 10 microns.

Figure 3:
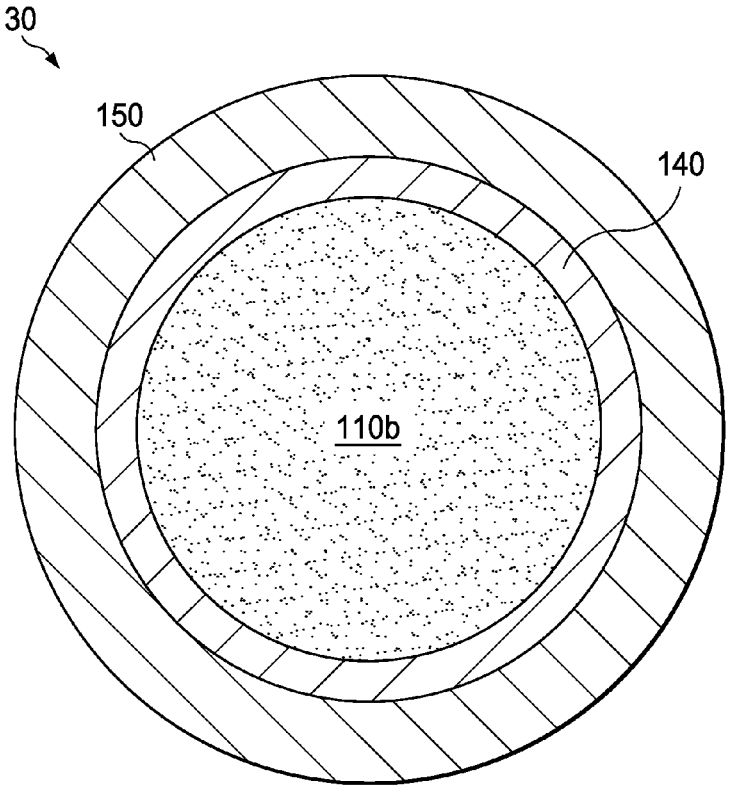
FIG. 3 is a cross-sectional drawing which illustrates the cross-section of a detonating cord with high impedance confinement.

Detonating cord 30 may also be formed from insensitive high explosive 110*b*, and, in some embodiments, is encased by high impedance materials rather than a conventional plastic jacket (which is a low impedance material). Specifically, as illustrated in FIG. 3, detonating cord 30 includes insensitive high explosive 110*b*, winding 140, and jacket 150. Winding 140 (which, in conventional systems, may normally include a cotton or polymer fiber) may be made from a metal (e.g., steel or copper). Jacket 150 (which, in conventional systems, may normally include plain plastic) may be doped with dense metal powders such as tungsten. Both a winding and a jacket as described above may be used. In another embodiment, the entire winding and plastic jacket may be replaced with a metal tube. The effect of employing a winding 140 and/or a jacket 150 made of high impedance material may provide higher mass confinement around the explosive core and more reliable detonation propagation.

Figure 4:
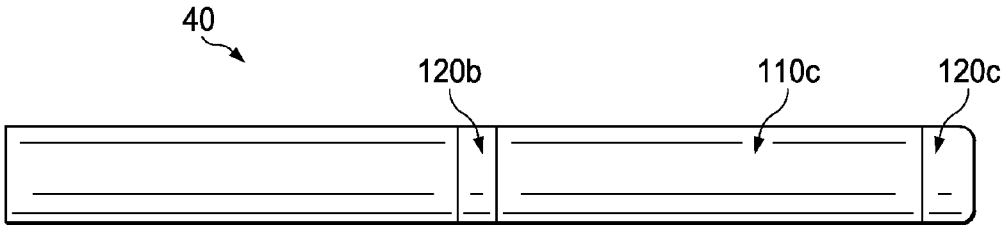
FIG. 4 is a schematic drawing which illustrates a bi-directional booster.

Bi-directional booster 40 is further illustrated in FIG. 4. Although FIG. 1 illustrates two bi-directional boosters 40, perforating system 10 may contain one, two, or a plurality of bi-directional boosters. Bi-directional booster 40 may contain insensitive high explosive 110*c* between two regions of superfine insensitive high explosive 120 and 120*c*. Although FIG. 1 and FIG. 3 illustrate bi-directional boosters, a uni-directional booster may be used in some applications. Such a booster may contain only one region of superfine insensitive high explosive.

Figure 5:
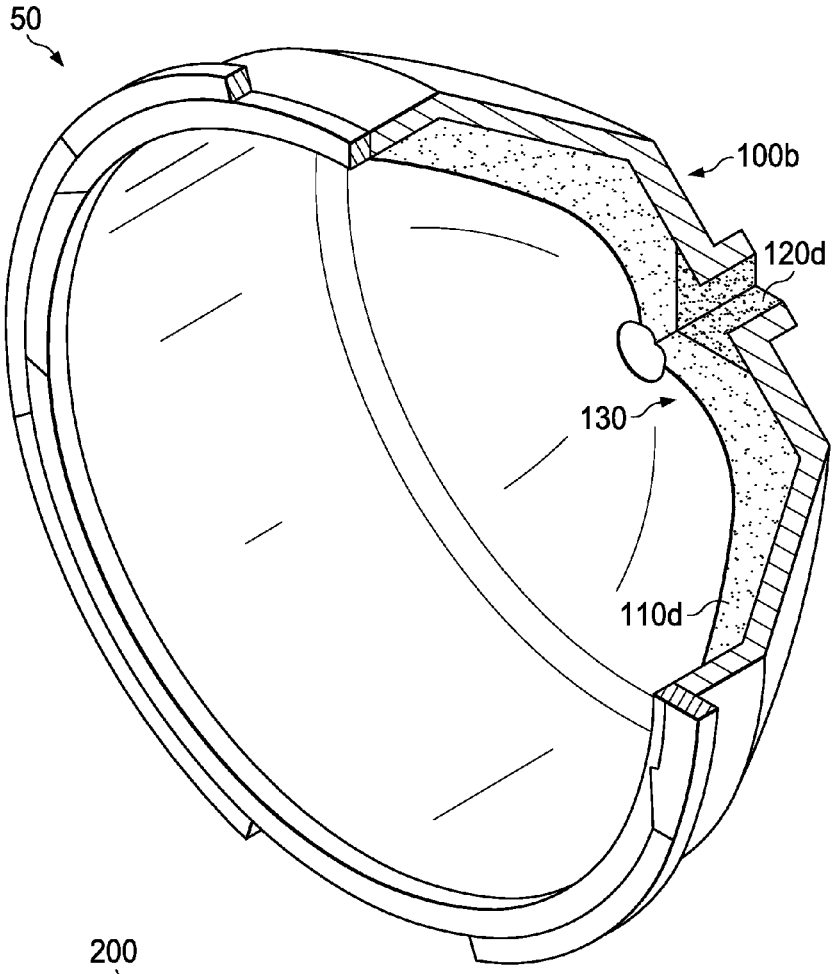
FIG. 5 is a partial cross-sectional drawing which illustrates a shaped charge.

Shaped charge 50 is further illustrated in FIG. 5 and includes high impedance confinement 100*b*, which contains booster charge 120*d*, formed from superfine insensitive high explosive, and explosive belt 130, which includes an insensitive high explosive 110*d* as a main charge.

Insensitive high explosive 110*d* may be formed primarily from the pure explosive material, but in some embodiments, such as in explosive belt 130, it may further contain a binder to help give the explosive material a particular shape or to improve coherence of the material during fabrication operations. Insensitive high explosive 110 located in other portions of perforating system 10, such as in detonating cord 30, may also contain binder.

Perforating system 10 is shown in FIG. 1 with multiple shaped charges 50, but it may contain one, two, or a plurality of shaped charges 50 depending on the desired perforation. Shaped charges 50 may also be located in perforation system 10 and contain amounts of high explosive 110*d* determined by the desired perforation. The shaped charges 50 may be arranged in a helix, at discrete intervals along the length of the perforating gun, or in any other appropriate arrangement.

Explosive components, such as explosive belt 130, may have a thickness at least greater than the failure diameter for the insensitive high explosive they contain.

In some embodiments, enhanced detonation transfer techniques may be used due to the insensitivity of even superfine powders. For instance, bi-directional or uni-directional boosters may be configured using end geometry that is thick and curved (FIG. 6 and FIG. 7) Upon detonation, the curved flyer plate becomes flat and provides a flat-topped shock wave of sustained duration when impacted against an acceptor explosive.

Figures 6A, 6B:
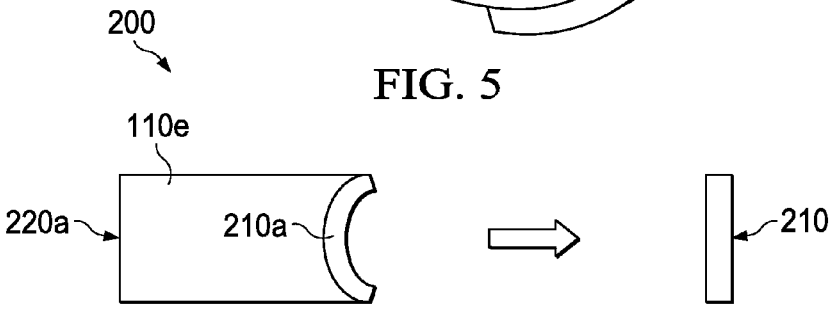
FIG. 6A is a schematic drawing which illustrates a bi-directional booster with thick, curved end geometry.
FIG. 6B is a schematic drawing which illustrates the booster of FIG. 6A after detonation.

Specifically, FIG. 6 illustrates a output end 200, which includes container 220*a* that contains insensitive high explosive 110*e*. Output end 200 also includes a thick output liner in the form of a flyer plate 210*a*, which is curved before detonation as illustrated in FIG. 6A. Flyer plate 210 is flattened and in flight after detonation, as illustrated in FIG. 6B.

Figure 7:
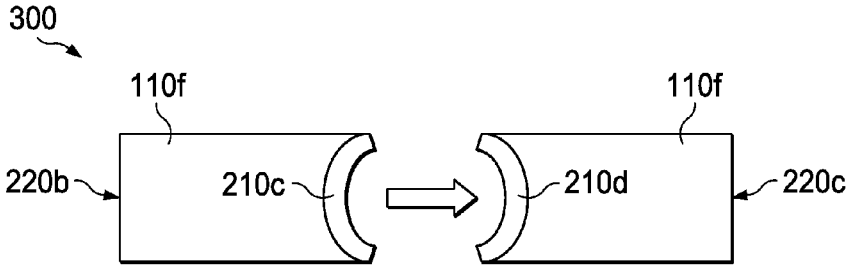
FIG. 7 is a schematic drawing which illustrates donor and acceptor bi-directional boosters with curved end geometry.

FIG. 7 illustrates bi-directional booster 300 with donor container 220*c* and acceptor container 220*d*, both containing insensitive high explosive 110*f*. Donor container 220*c* contains flyer plate 210*c*, which is curved before detonation. Acceptor container 220*d* also contains flyer plate 210*d*, which is curved before detonation. After detonation, flyer plate 210*d* travels from donor container 220*c* to acceptor container 220*d*.

Figure 8:
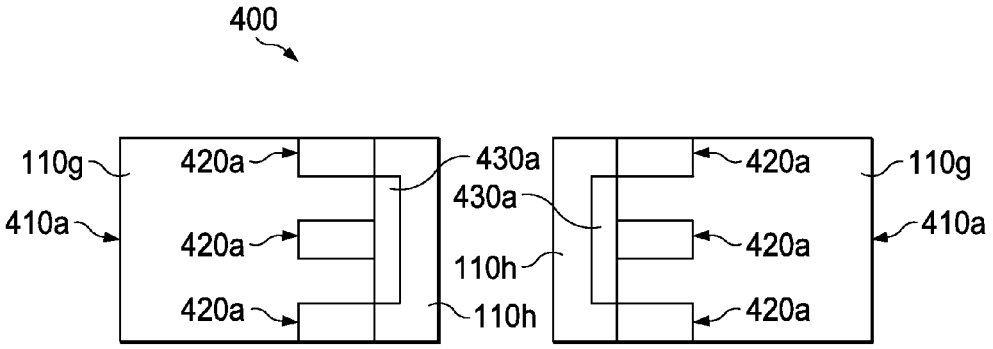
FIG. 8 is a schematic drawing which illustrates donor and acceptor bi-directional boosters using flat flyers and embedded anvils.
Figure 9:
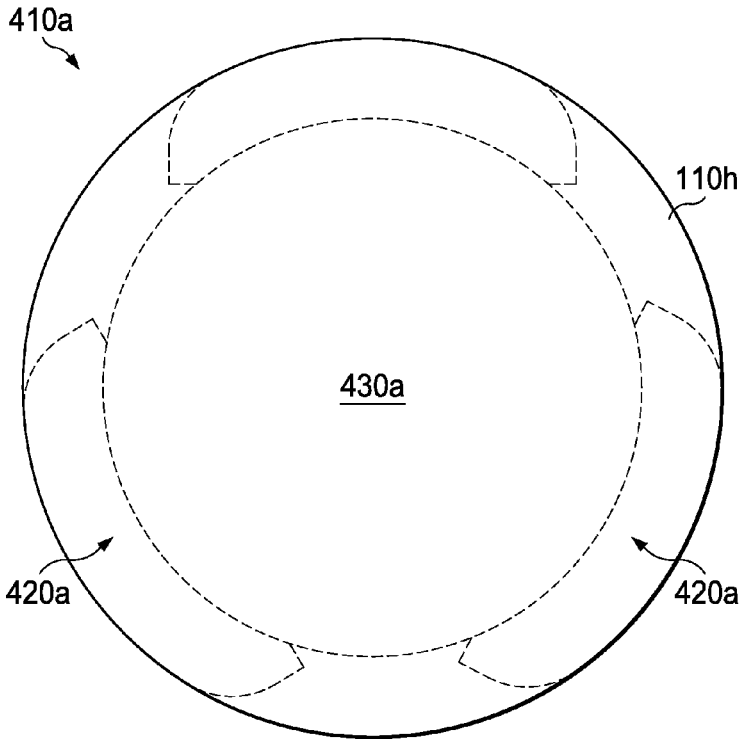
FIG. 9 is an end view which illustrates a booster as shown in FIG. 8.

Moreover, detonation transfer in the acceptor booster can be enhanced by inclusion of an embedded anvil or sometimes alternately called shock reflector (FIG. 8 and FIG. 9).

FIG. 8 illustrates bi-directional booster 400, which includes containers 410*a* with insensitive high explosive 110*g* and 110*h* and anvils 420*a*, which, upon detonation, contact flyer plates 430*a*. In this example, flyer plates 430*a* are flat. FIG. 9 illustrates an end view of one container 410*a* such that radial placement of anvils 420*a* may be seen.

Figure 10:
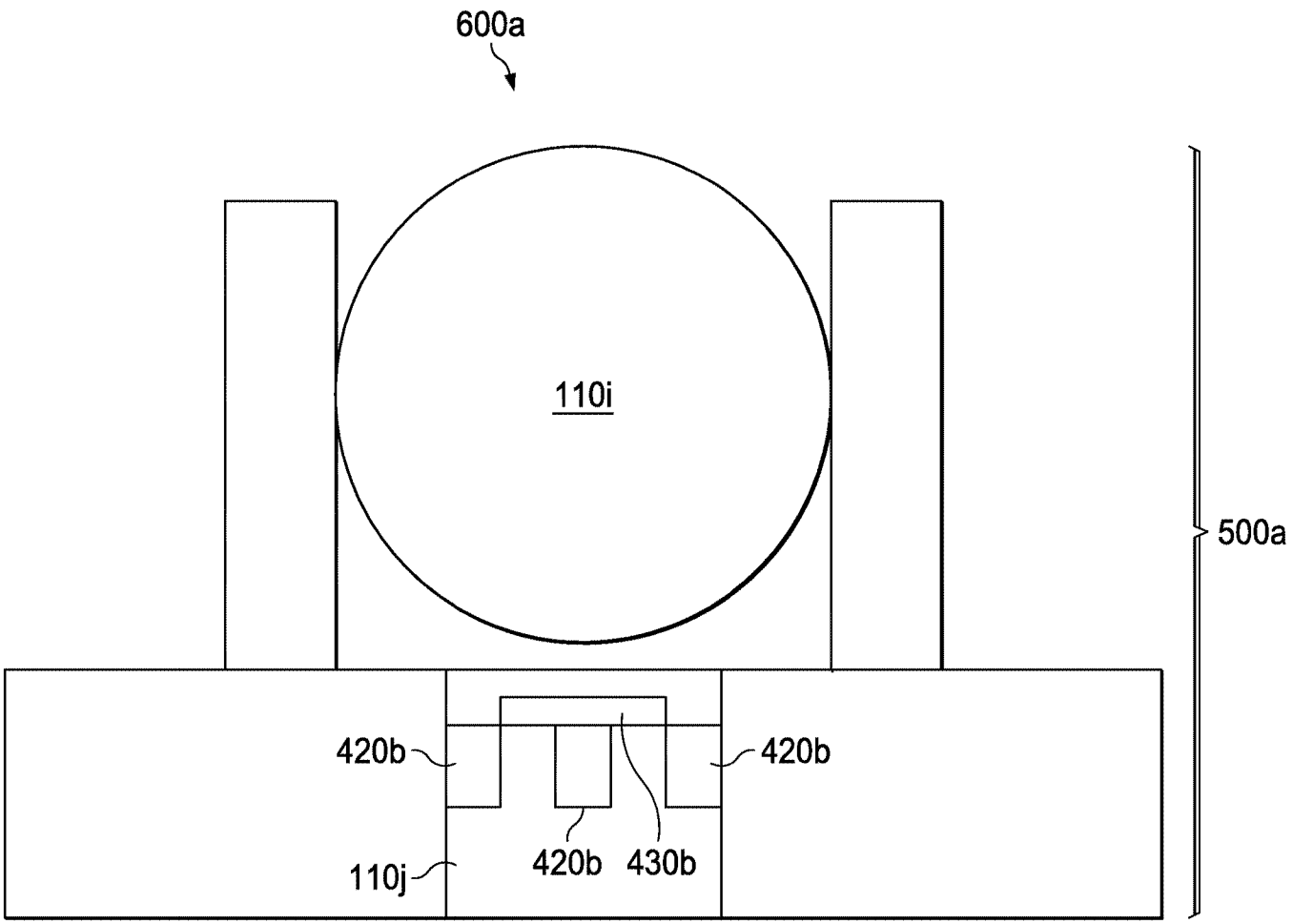
FIG. 10 is a drawing which illustrates detonation transfer from the detonating cord to the booster area of the shaped charge using an embedded anvil.
Figure 11:
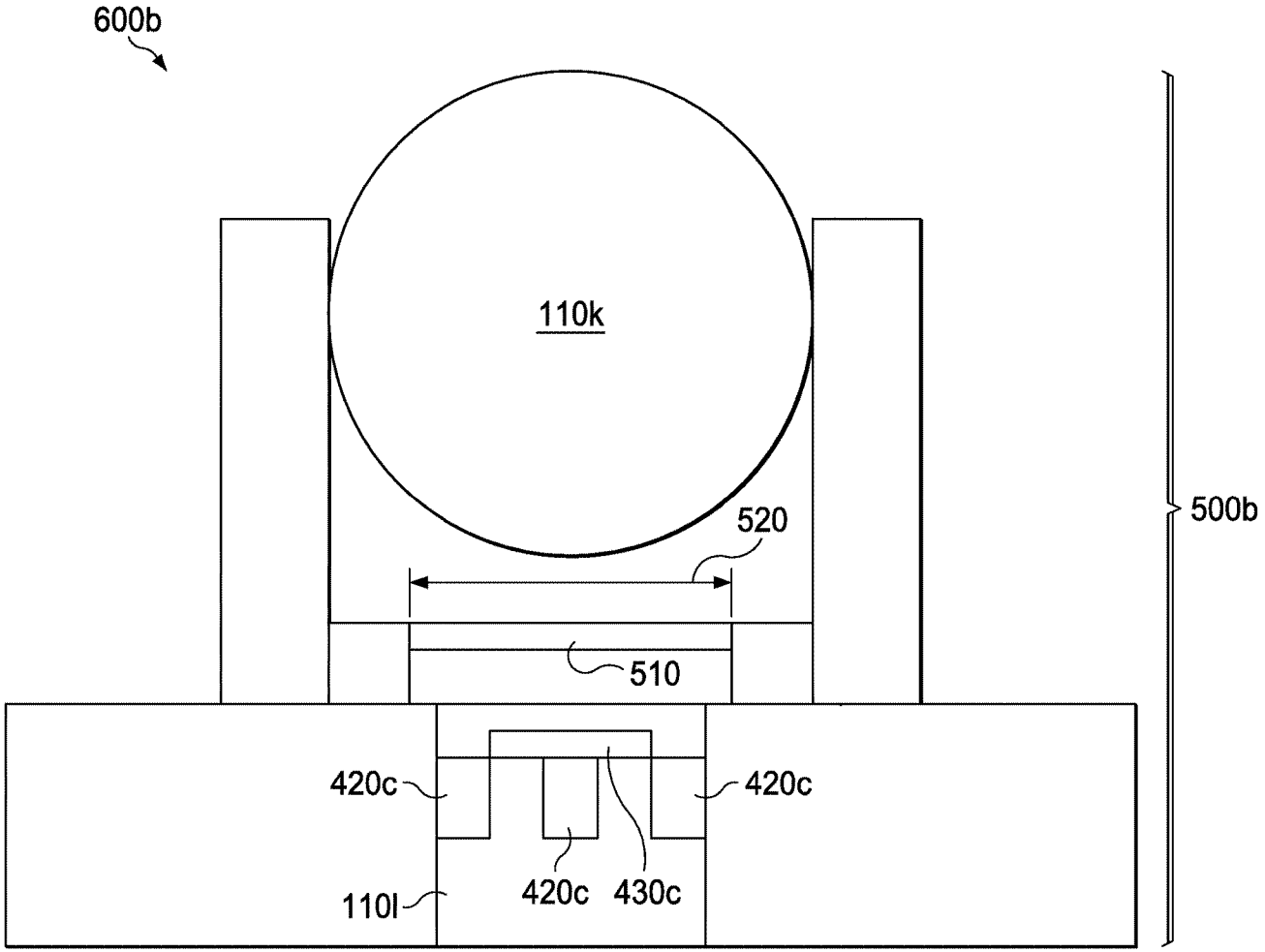
FIG. 11 is a drawing which illustrates detonation transfer from the detonating cord to the booster area of the shaped charge using a flyer plate and embedded anvil.

In addition, the booster 500*a* of the shaped charge 600*a* may be configured singularly with an embedded anvil 420*b* and flyer plate 430*b* (FIG. 10), or with the addition of an external flyer plate 510*a* and spacers 530*a* along with embedded anvil 420*c* and flyer plate 430*c* (FIG. 11). In the embodiment shown in FIG. 11, flyer plate 510*a* breaks off from spacers 530*a* and impact flyer plate 430*c*.

Figure 12:
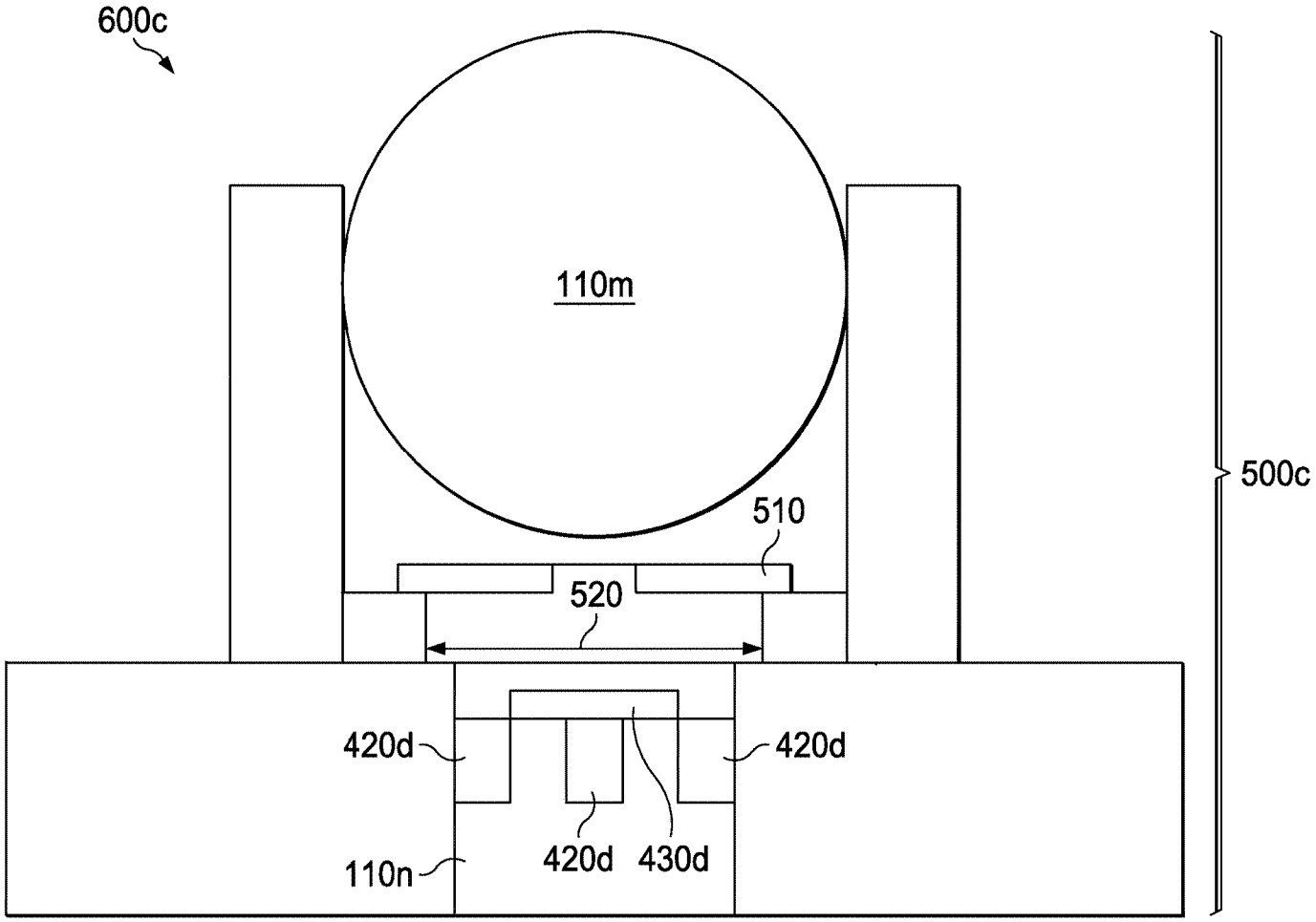
FIG. 12 illustrates detonation transfer from the detonating cord to the booster area of the shaped charge using a slapper or bubble plate and embedded anvil.

In an alternative embodiment 600*c*, shown in FIG. 12, flyer plate 510*b* is a slapper or bubble plate and does not break off from spacers 530*b* before impact with flyer plate 430*d*. (FIG. 11).

In the embodiments, shaped charge 600*a* contains insensitive high explosive 110*i* and 110*j*, shaped charge 600*b* contains insensitive high explosive 110*k* and 110*l*, and shaped charge 600*c* contains insensitive high explosive 100*m* and 110*n*. The insensitive high explosive may be superfine high explosive.

Insensitive high explosive 110 may have higher test values for impact sensitivity, friction sensitivity, or spark sensitivity, than that of high explosives currently used in perforating systems, either as the charge explosive or as the explosive used in a detonator or booster. In particular, one of these properties may be higher (i.e., less sensitive) than the corresponding property of cyclotrimethylenetrinitramine (also known as 1,3,5-Trinitro-1,3,5-triazacyclohexane and 1,3,5-Trinitrohexahydro-s-triazine) (RDX), cyclotetramethylene-tetranitramine (also known as tetrahexamine tetranitramin and octahydro-1,3,5,7-tetranitro-1,3,5,7-tetrazocine) (HMX), hexanitrostilbene (also known as 1,1'-(1,2-ethenediyl)bis[2,4,6-trinitrobenzene]; 1,2-bis-(2,4,6-trinitrophenyl)-ethylene; and hexanitrodiphenylethylene) (HNS), 2,6-bis(picrylamino)-3,5-dinitropyridine (also known as 2,6-Pyridinediamine and 3,5-dinitro-N,N'-bis(2,4,6-trinitrophenyl)) (PYX), 2,2',2",4,4',4",6,6',6"-Nonanitro-m-terphenyl (NONA), 3,5-trinitro-2,4,6-tripicrylbenzene (BRX), lead azide, silver azide, or titanium subhydride potassium perchlorate (THKP).

The insensitive high explosive may be chosen to reliably initiate throughout an entire explosive train, which may consist of one or more perforation systems or components thereof, such as a booster and shaped charges. The insensitive high explosive may also be chosen to meet a selected performance criterion after thermal exposure to a prescribed time-temperature combination.

In example embodiments, the insensitive high explosive may include one or a combination of triaminotrinitrobenzene (also known as 2,4,6-triamino-1,3,5-trinitrobenzene) (TATB), diamino-trinitrobenzene (also known as 2,4,6 trinitro-1,3 denzenediamine) (DATB), hexanitroazobenzene (also known as 2,2',4,4',6,6'-hexanitroazobenzene) (HNAB), or 3-nitro-1,2,4-triazol-5-one (NTO).

Insensitive high explosive 110 found in different parts of perforating system 10, such as insensitive high explosive 110*a*, 100*b*, and 110*c* may be the same insensitive high explosive, or one or more different ones. Similarly, superfine insensitive high explosive 120 may be the same or different from any insensitive high explosive 110. Also, superfine insensitive high explosive 120 found in different parts of perforating system 10, such as insensitive high explosive 120*a*, 120*b*, 120*c*, and 120*d* may be the same superfine insensitive high explosive, or one or more different ones. The same or different high explosives may be selected based on the desired explosive properties of perforating system 10. Different shaped bi-directional boosters 40 and shaped charges 50 within the same perforating system 10 may also contain different insensitive high explosives.

The casing of a wellbore may be perforated using a perforation system as described above by detonating the insensitive high explosive. In particular, a signal, either percussion, electrical, or optical may be supplied to the detonator 15 which then initiates the detonating cord initiator 20, which then detonates superfine insensitive high explosive 120*a*, next detonating insensitive high explosive 110*a*. The explosion is contained by high impedance confinement 100*a* and travels to detonating cord 30, then to bi-directional boosters 40, where it first detonates superfine insensitive high explosive 120*b* and 120*c*, before detonating insensitive high explosive 110*b*. Finally the explosion travels to shaped charges 50, where it first detonates superfine insensitive high explosive 120*d*, then insensitive high explosive 110*c*. Detonation of shaped charges 50 perforates the wellbore, for example by perforating a well casing.

Insensitive high explosives may improve the safety of perforation methods as compared to methods using traditional high explosive because traditional high explosives may detonate inappropriately, particularly in accident scenarios, such as fires, or during retrieval of misfired perforating systems, while insensitive high explosives are less likely to do so. In addition, the relative insensitivity of insensitive high explosives may improve safety when perforation systems are loaded at the shop, during highway, air, or water transport, during wellsite handling, and when downloading into the well.

Embodiments disclosed herein include:

A. A wellbore perforation system that includes at least one detonator and at least one shaped charge. The shaped charge includes an insensitive high explosive and is operable to perforate a wellbore.

B. A shaped charge for a wellbore perforation system that includes a main charge including an insensitive high explosive and operable to perforate a wellbore.

Each of embodiments A and B may have one or more of the following additional elements in any combination: Element 1: A detonator that may additionally include an insensitive high explosive. Element 2: The insensitive high explosive may include a material selected from the group consisting of triaminotrinitrobenzene (TATB), diamino-trinitrobenzene (DATB), hexanitroazobenzene (HNAB), 3-nitro-1,2,4-triazol-5-one (NTO), and any combinations thereof. Element 3: A detonating cord initiator that may include an insensitive high explosive or superfine insensitive high explosive. Element 4: A booster that may include insensitive high explosive and superfine insensitive high explosive. Element 5: The booster may include a flyer plate. Element 6: The flyer plate may be curved. Element 7: The flyer plate may be flat. Element 8: The booster may include an anvil. Element 9: The booster may include at least two radially placed anvils. Element 10: The booster may include a flyer plate. Element 11: The booster may include a bi-directional booster and two regions of superfine insensitive high explosive. Element 12: The bi-directional booster may include two flyer plates, one associated with a donor container and one associated with an acceptor container. Element 13: The system or shaped charge may include an external flyer plate. Element 14: The system or shaped charge may include a superfine insensitive high explosive. Element 15: The insensitive high explosive may include a binder. Element 16: The superfine insensitive high explosive may have an average particle size of between 1 micron and 50 microns.

Embodiments A and B and any of elements 1-16 combined therewith may function in the manner of, or include physical features of Embodiments C and D and any of elements 17-32 combined therewith as described below.

Additional embodiments include:

C. A method of perforating a wellbore by detonating a perforation system in the wellbore to form at least one perforation in the wellbore. The perforation system includes at least one shaped charge including an insensitive high explosive.

D. A method of forming at least one perforation in the casing of a wellbore by detonating a detonator, a booster, and at least one shaped charge in a perforation system in the wellbore to form at least one perforation in the casing of the wellbore. The shaped charge includes an insensitive high explosive.

Each of embodiments C and D may have one or more of the following additional elements in any combination: Element 17: The perforation is formed in a casing of the wellbore. Element 18: The perforation system further includes a detonator, and detonating includes detonating the detonator. Element 19: The detonator additionally includes an insensitive high explosive and detonating the perforation system includes detonating the detonator, which then results in detonation of the shaped charge. Element 20: The insensitive high explosive includes a material selected from the group consisting of triaminotrinitrobenzene (TATB), diamino-trinitrobenzene (DATB), hexanitroazobenzene (HNAB), 3-nitro-1,2,4-triazol-5-one (NTO), and any combinations thereof, and detonating the perforation system includes detonating the insensitive high explosive. Element 21: The perforation system includes a detonating cord initiator including an insensitive high explosive, and detonating the perforation system includes detonating the detonating cord, which then results in detonation of the detonator and the shaped charge. Element 22: The perforation system includes a booster including an insensitive high explosive, and detonating the perforation system includes detonating the at least one detonator, which results in detonation of the at least one booster and the at least one shaped charge. Element 23: The booster includes a flyer plate and detonation causes flyer plate to form a flat-topped shock wave of sustained duration. Element 24: The flyer plate includes a curved flyer plate and detonation causes the flyer plate to flatten. Element 25: The booster includes an anvil and detonation causes the anvil to move. Element 26: The booster includes an anvil and a flyer plate and detonation causes the anvil to strike the flyer plate. Element 27: The system or shaped charge includes an external flyer plate and spacers, and detonation causes the external flyer plate to move. Element 28: The external flyer plate breaks free from the spacers when it moves. Element 29: The booster includes a bi-directional booster and detonation causes movement in two directions. Element 30: The bi-directional booster includes a donor container with an associated donor flyer plate and an acceptor container with an associated acceptor flyer plate, and detonation causes the donor flyer plate to strike the acceptor flyer plate. Element 31: The shaped charge includes a main charge including an insensitive high explosive, and the main charge perforates the wellbore. Element 32: The perforation system includes a superfine insensitive high explosive with an average particle size of between 1 micron and 50 microns, and detonating the perforation system includes detonating the superfine insensitive high explosive.

Embodiments C and D and any of elements 17-32 combined therewith may function in the manner of, or include physical features of Embodiments A and B and any of elements 1-16 combined therewith as described above.

Although only exemplary embodiments of the invention are specifically described above, it will be appreciated that modifications and variations of these examples are possible without departing from the spirit and intended scope of the invention.

The invention claimed is:

1. A method of perforating a wellbore, comprising detonating a perforation system in the wellbore to form at least one perforation in the wellbore, wherein the perforation system includes at least one shaped charge, each shaped charge including a first insensitive high explosive, and at least one booster, the at least one booster including a second insensitive high explosive, an anvil, and a flyer plate and detonation causes the anvil to move and strike the flyer plate.

2. The method of claim 1, wherein the perforation is formed in a casing of the wellbore.

3. The method of claim 1, wherein the perforation system further comprises a detonator, and wherein detonating comprises detonating the detonator.

4. The method of claim 3, wherein the detonator additionally comprises a third insensitive high explosive, and wherein detonating the perforation system comprises detonating the detonator, which then results in detonation of the at least one shaped charge.

5. The method of claim 1, wherein the first insensitive high explosive comprises a material selected from the group consisting of triaminotrinitrobenzene (TATB), diamino-trinitrobenzene (DATB), hexanitroazobenzene (HNAB), 3-nitro-1,2,4-triazol-5-one (NTO), and any combinations thereof, and wherein detonating the perforation system comprises detonating the first insensitive high explosive.

6. The method of claim 1, wherein the perforation system further comprises at least one detonator, at least one detonating cord initiator comprising a third insensitive high explosive, and a detonator cord, and wherein detonating the perforation system comprises detonating the detonating cord, which then results in detonation of the at least one detonator and the at least one shaped charge.

7. The method of claim 1, wherein the perforation system further comprises at least one detonator, and wherein detonating the perforation system comprises detonating the at least one detonator, which results in detonation of the at least one booster and the at least one shaped charge.

8. The method of claim 1, wherein detonation causes the flyer plate to form a flat-topped shock wave.

9. The method of claim 1, wherein the flyer plate comprises a curved flyer plate and detonation causes the flyer plate to flatten.

10. The method of claim 1, wherein each booster further comprises an external flyer plate and spacers, and wherein detonation causes the external flyer plate to move.

11. The method of claim 10, wherein the external flyer plate breaks free from the spacers when it moves.

12. The method of claim 1, wherein each shaped charge comprises a main charge comprising a third insensitive high explosive, and wherein the main charge perforates the wellbore.

13. The method of claim 1, wherein the perforation system further comprises a superfine insensitive high explosive with an average particle size of between 1 micron and 50 microns, and wherein detonating the perforation system comprises detonating the superfine insensitive high explosive.

* * * * *